US011537081B2

(12) United States Patent
Bazin

(10) Patent No.: US 11,537,081 B2
(45) Date of Patent: Dec. 27, 2022

(54) COMPONENT OF EXTERNAL PARTS FOR A TIMEPIECE MADE OF WELDED MATERIALS

(71) Applicant: The Swatch Group Research and Development Ltd, Marin (CH)

(72) Inventor: Jean-Luc Bazin, Publier (FR)

(73) Assignee: The Swatch Group Research and Development Ltd, Marin (CH)

( * ) Notice: Subject to any disclaimer, the term of this patent is extended or adjusted under 35 U.S.C. 154(b) by 700 days.

(21) Appl. No.: 15/312,802

(22) PCT Filed: May 22, 2015

(86) PCT No.: PCT/EP2015/061458
§ 371 (c)(1),
(2) Date: Nov. 21, 2016

(87) PCT Pub. No.: WO2015/185383
PCT Pub. Date: Dec. 10, 2015

(65) Prior Publication Data

US 2017/0139376 A1 May 18, 2017

(30) Foreign Application Priority Data

Jun. 3, 2014 (EP) ..... 14171019

(51) Int. Cl.
*G04B 37/22* (2006.01)
*G04D 3/00* (2006.01)

(52) U.S. Cl.
CPC ..... *G04B 37/22* (2013.01); *G04D 3/00* (2013.01)

(58) Field of Classification Search
CPC ..... G04B 37/22
(Continued)

(56) References Cited

U.S. PATENT DOCUMENTS 4,782,209 A * 11/1988 Caers ..... C04B 37/026 219/121.64
2004/0082145 A1* 4/2004 Reichenbach ..... B29C 65/1683 438/455

(Continued)

FOREIGN PATENT DOCUMENTS

CH 707 164 A2 5/2014
EP 1 436 830 A1 7/2004

(Continued)

OTHER PUBLICATIONS

Machine English Translation of EP2579104, provided by the Espace.net website, internet retrieval date of Mar. 26, 2019. (Year: 2013).*

(Continued)

*Primary Examiner* — Archene A Turner
(74) *Attorney, Agent, or Firm* — Oblon, McClelland, Maier & Neustadt, L.L.P.

(57) ABSTRACT

A component of external parts for a timepiece, the component including a first silicon-based part and a second metal-based part, where one surface of the first part is welded using laser-type electromagnetic radiation onto a surface of the second part in order to secure the parts to each other. A method for fabrication of a component of external parts for a timepiece, by forming a first silicon-based part and a second metal-based part, mounting a surface of the first part on a surface of the second part, and welding, using laser-type electromagnetic radiation, the surface of the first part mounted on the surface of the second part, in order to secure the parts to each other.

5 Claims, 1 Drawing Sheet

(58) Field of Classification Search
USPC ..... 428/446
See application file for complete search history.

(56) References Cited

U.S. PATENT DOCUMENTS

| | | | | |
|---|---|---|---|---|
| 2005/0136284 | A1 | 6/2005 | Grippo et al. | |
| 2008/0217821 | A1 | 9/2008 | Goring et al. | |
| 2013/0070428 | A1 | 3/2013 | Kangastupa et al. | |
| 2016/0370763 | A1* | 12/2016 | Cusin | G04B 17/34 |
| 2018/0104771 | A1* | 4/2018 | Cusin | G04D 3/00 |

FOREIGN PATENT DOCUMENTS

| | | | |
|---|---|---|---|
| EP | 1 548 524 | A1 | 6/2005 |
| EP | 2 579104 | A2 | 4/2013 |
| WO | 2011/144813 | A2 | 11/2011 |

OTHER PUBLICATIONS

Machine English Translation of EP2796939, provided by the Espace.net website, internet retrieval date of Mar. 26, 2019. (Year: 2014).*
"Microelectronic Packaging: Electrical Interconnections", H.K. CharlesJr., in Encyclopedia of Materials: Science and Technology, 2001, 20 pages. (Year: 2001).*
International Search Report dated Jan. 29, 2016 in PCT/EP2015/061458 filed May 22, 2015.
Andre Perret, "Le Silicium Comme Materiau Dans La Fabrication De Pieces Mecaniques", Bulletin de la Societe Suisse de Chronometrie, Nov. 9, 2001, No. 38, pp. 27-29, XP002460036.

* cited by examiner

COMPONENT OF EXTERNAL PARTS FOR A TIMEPIECE MADE OF WELDED MATERIALS

FIELD OF THE INVENTION

The invention relates to a component of external parts made of welded materials and notably such a component comprising a silicon-based or ceramic-based material.

BACKGROUND OF THE INVENTION

Current assemblies including a silicon-based or ceramic-based material can be joined by adhesive bonding. There have also been developed intermediate parts capable of plastic deformation, intended to be pressed in while protecting the silicon-based or ceramic-based component. However, they are not always satisfactory, since, depending on the application, they may be difficult to implement.

SUMMARY OF THE INVENTION

It is an object of the present invention to overcome all or part of the aforementioned drawbacks, by proposing a component of external parts formed from a part comprising a silicon-based or ceramic-based material which is welded by electromagnetic radiation directly onto another part, such as, for example, a metal or a metal alloy.

To this end, according to a first embodiment, the invention relates to a component of external parts for a timepiece comprising a first silicon-based part, a second metal-based part, characterized in that one surface of the first part is welded using laser-type electromagnetic radiation onto a surface of the second part in order to join or secure them.

According to the invention, the first silicon-based part contains single crystal silicon, doped single crystal silicon, polycrystalline silicon, doped polycrystalline silicon, porous silicon, silicon oxide, quartz, silica, silicon nitride or silicon carbide.

According to a second embodiment, the invention relates to a component of external parts for a timepiece comprising a first ceramic-based part, a second metal-based part, characterized in that one surface of the first part is welded using laser-type electromagnetic radiation onto a surface of the second part in order to join or secure them.

According to the invention, the first ceramic-based part contains photostructurable glass, borosilicate, aluminosilicate, quartz glass, zerodur, single crystal corundum, polycrystalline corundum, alumina, aluminium oxide, aluminium nitride, single crystal ruby, polycrystalline ruby, zirconium oxide, titanium oxide, titanium nitride, titanium carbide, tungsten nitride, tungsten carbide, boron nitride or boron carbide.

Advantageously according to the two embodiments of the invention, it is understood that the direct welding of the surfaces makes the joint substantially invisible since the electromagnetic radiation acts directly on the interface between the two parts. Consequently, the component is of the composite type and it not possible to discern how it was obtained except by destructive inspection. Advantageously according to the invention, already developed parts can thus be used and henceforth joined to each other with improved adherence and a better guarantee of performance over time than with adhesive bonding.

Finally, the ceramic-based or silicon-based parts do not need to have elastic or plastic deformation means to prevent them being broken during assembly since the welding directly joins or secures the surfaces of the ceramic-based or silicon-based parts to the surfaces of the metal-based parts. The immediate advantage in the field watchmaking is thus clear, both from the point of view of compactness (no additional volume required for elastic or plastic deformation means) and robustness (material-material weld).

According to other advantageous variants of the two embodiments of the invention:

- the first silicon-based or ceramic-based part also includes at least a partial coating of silicon oxide, silicon nitride, silicon carbide or an allotrope of carbon;
- the first part and/or the second part forms a case, a case middle, a horn, a dial, a flange, a bezel, a push-button, a crown, a case back, a hand, a bracelet or wristlet, a link, a clasp, a decoration, an applique, a crystal, a dial-foot, a winding stem, a push-button stem;
- the second part includes an iron alloy, a copper alloy, a nickel alloy, titanium or an alloy thereof, gold or an alloy thereof, silver or an alloy thereof, platinum or an alloy thereof, ruthenium or an alloy thereof, rhodium or an alloy thereof, or palladium or an alloy thereof.

Further, the invention relates to a timepiece, characterized in that it includes a component according to any of the preceding variants.

Additionally, the invention also relates to a method for fabrication of a component of external parts according to the first embodiment for a timepiece comprising the following steps:

- forming a first silicon-based part and a second metal-based part;
- mounting a surface of the first part on a surface of the second part;
- welding, using laser-type electromagnetic radiation, the surface of the first part mounted on the surface of the second part, in order to join or secure them to each other.

Finally, the invention also relates to a method for fabrication of a component of external parts according to the second embodiment for a timepiece comprising the following steps:

- forming a first ceramic-based part and a second metal-based part;
- mounting a surface of the first part on a surface of the second part;
- welding, using laser-type electromagnetic radiation, the surface of the first part mounted on the surface of the second part, in order to join or secure them to each other.

Advantageously according to the two embodiments of the invention, it is understood that the method is simple, fast and that it is not necessary to add material to join or secure the two materials or to apply a joining force to the first and second parts. Further, laser-type electromagnetic radiation offers great flexibility as regards the location and shape (flat, sloping, non-rectilinear, etc.) of the areas that are to be welded. It is therefore understood that already developed parts can thus be used and henceforth joined or secured to each other with improved adherence and a better guarantee of performance over time than with adhesive bonding.

According to other advantageous variants of the two embodiments of the invention:

- the first silicon-based or ceramic-based part also includes at least a partial coating of silicon oxide, silicon nitride, silicon carbide or an allotrope of carbon;

one of the first and second parts is opaque to the wavelength of said electromagnetic radiation so as to weld said surfaces of the first and second parts when they are one against the other;

an intermediate material is deposited at the interface of the first and second parts when the latter are transparent to the wavelength of said laser-type electromagnetic radiation so as to induce sufficiently intense heating to weld said first and second parts;

the first part and/or the second part forms a case, a case middle, a horn, a dial, a flange, a bezel, a push-button, a crown, a case back, a hand, a bracelet or wristlet, a link, a clasp, a decoration, an applique, a crystal, a dial-foot, a winding stem, a push-button stem;

the second part includes an iron alloy, a copper alloy, a nickel alloy, titanium or an alloy thereof, gold or an alloy thereof, silver or an alloy thereof, platinum or an alloy thereof, ruthenium or an alloy thereof, rhodium or an alloy thereof, or palladium or an alloy thereof.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
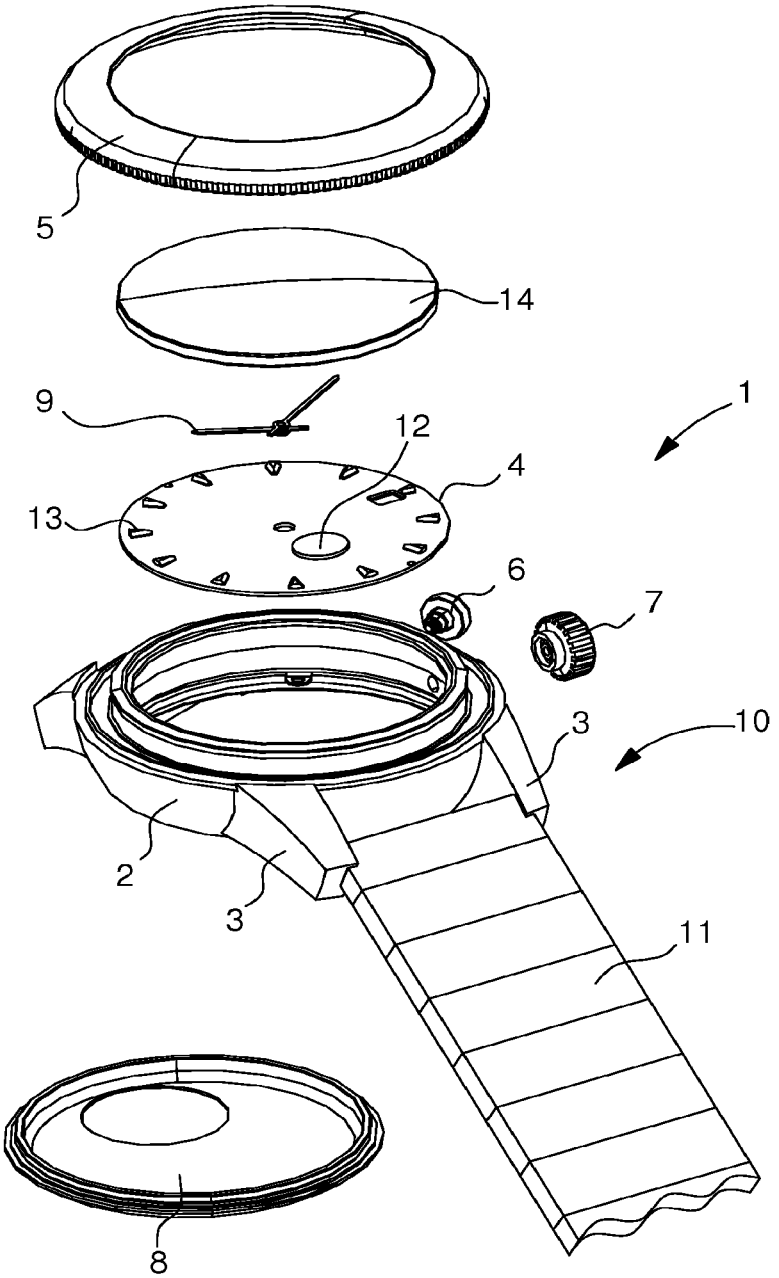
FIG. 1 is a perspective view of external parts according to the invention.

As explained above, the invention relates to a component of external parts formed with the aid of a part whose material has no usable plastic range, i.e. a very limited plastic range, and a second part comprising the same type of material or a different type of material.

This component was devised for applications in the field of watchmaking and is rendered necessary by the increasing part played by fragile materials, such as silicon-based or ceramic-based materials. It is possible, for example, to envisage forming a case, a dial, a flange, a crystal, a bezel, a push-button, a crown, a case back cover, a hand or a bracelet or wristlet completely or partially from fragile materials.

However, always having to use ordinary parts, such as, for example, corundum crystals, the production of which is mastered, is a constraint which is difficult to reconcile with the use of parts having no plastic range.

This is why, according to a first embodiment, the invention relates to a component of external parts for a timepiece comprising a first silicon-based part, a second metal-based part, characterized in that one surface of the first part is welded using electromagnetic radiation welding onto a surface of the second part in order to join or secure them.

Advantageously according to the invention, it is understood that it is not essential to add material in order to join or secure the two parts, as is the case with adhesive bonding or the use of an intermediate part. Thus, by way of example, a simple hole allowing for cooperation with a case of corresponding cross-section is sufficient, with the hole formed in the first part or in the second part.

It is therefore understood that already developed parts can thus be used and henceforth welded by electromagnetic radiation with improved adherence and a better guarantee of performance over time than with adhesive bonding. Finally, the direct welding of the surfaces makes the joint substantially invisible. Indeed, it is sufficient for one of the first and second parts to be opaque and the other transparent to the wavelength of said electromagnetic radiation in order to weld said surfaces of the first and second parts when they are one against the other. Such welding by laser-type electromagnetic radiation is, for example, explained in EP Patent 1436830, which is incorporated by reference in the present description. Further, as explained in EP Patent 1436830, if the first and second parts are transparent to the wavelength of said laser-type electromagnetic radiation, optionally, an intermediate material intended to enhance the joint between the two materials may be used. Thus, the intermediate material forms a layer intended to induce sufficiently intense heating to cause the fusion of the two materials.

According to the first embodiment, the first silicon-based part preferably includes single crystal silicon, doped single crystal silicon, polycrystalline silicon, doped polycrystalline silicon, porous silicon, silicon oxide, quartz, silica, silicon nitride or silicon carbide. Further, the first silicon-based part may also optionally include at least a partial coating of silicon oxide, silicon nitride, silicon carbide or an allotrope of carbon, depending upon the intended applications of the component.

According to a second embodiment, the invention relates to a component of external parts for a timepiece comprising a first ceramic-based part, a second metal-based part, characterized in that one surface of the first part is welded using electromagnetic radiation onto a surface of the second part in order to join or secure them.

Advantageously according to the invention, it is understood that it is not essential to add material in order to join or secure the two parts, as is the case with adhesive bonding or the use of an intermediate part. Thus, by way of example, a simple hole allowing for cooperation with a crystal of corresponding cross-section is sufficient, with the hole formed in the first part or in the second part.

It is therefore understood that already developed parts can thus be used and henceforth welded by electromagnetic radiation with improved adherence and a better guarantee of performance over time than with adhesive bonding. Finally, the direct welding of the surfaces makes the joint substantially invisible. Indeed, it is sufficient for one of the first and second parts to be opaque and the other transparent to the wavelength of said electromagnetic radiation in order to weld said surfaces of the first and second parts when they are one against the other. Such welding by laser-type electromagnetic radiation is, for example, explained in EP Patent 1436830, which is incorporated by reference in the present description. Further, as explained in EP Patent 1436830, if the first and second parts are transparent to the wavelength of said laser-type electromagnetic radiation, optionally, an intermediate material intended to enhance the joint between the two materials may be used. Thus, the intermediate material forms a layer intended to induce sufficiently intense heating to cause the fusion of the two materials.

According to the second embodiment, the first ceramic-based part preferably contains photostructurable glass, borosilicate, aluminosilicate, quartz glass, zerodur, single crystal corundum, polycrystalline corundum, alumina, aluminium oxide, aluminium nitride, single crystal ruby, polycrystalline ruby, zirconium oxide, titanium oxide, titanium nitride, titanium carbide, tungsten nitride, tungsten carbide, boron nitride or boron carbide. Further, the first ceramic-based part may also optionally include at least a partial coating of silicon oxide, silicon nitride, silicon carbide or an allotrope of carbon, depending upon the intended applications of the component.

According to the two embodiments, the second part preferably includes an iron alloy like 15P, 20AP or 316L steel, a copper alloy such as brass, a nickel alloy such as nickel silver, titanium or an alloy thereof, gold or an alloy thereof, silver or an alloy thereof, platinum or an alloy thereof, ruthenium or an alloy thereof, rhodium or an alloy thereof, or palladium or an alloy thereof.

According to the two embodiments of the invention, the first part and/or the second part may form a large variety of components for timepiece external parts. By way of non-limiting example and with reference to FIG. 1, the first part and/or the second part may therefore notably form a case 1, such as case middle 2 and horns 3, a dial 4, a flange, a bezel 5, a push-button 6, a crown 7, a case back 8, a hand 9, a bracelet or wristlet 10, such as a link 11, a decoration 12, an applique 13, a crystal 14, a clasp, a dial-foot, a winding stem, or a push-button stem.

Figure 2:
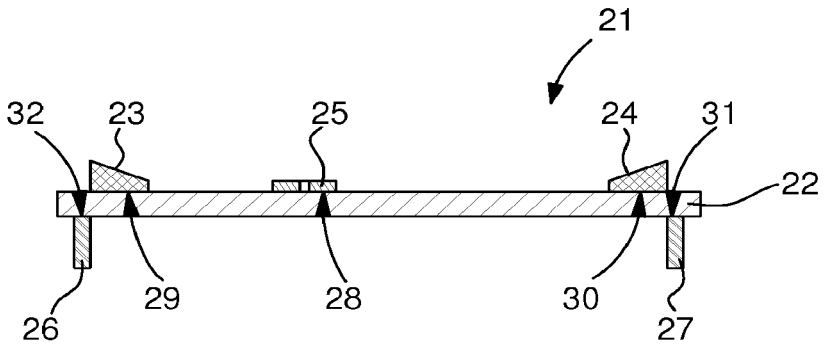
FIG. 2 is a cross-sectional view of a component according to the invention.

By way of example, FIG. 2 shows an component 21 of external parts forming a dial 22. The body of dial 22 includes several appliques 23, 24 forming, for example, an hour-circle, a decoration 25 which may, for example, represent a brand name, and several dial-feet 26, 27 for securing dial 22 to a timepiece.

It is thus understood, for example, that dial 22 can be welded using electromagnetic radiation, such as a laser, directly onto its contact surfaces 28, 29, 30, 31, 32 with appliques 23, 24 and/or decoration 25 and/or feet 26, 27. Either dial 22, or appliques 23, 24 and/or decoration 27 simply need to be transparent to the wavelength of said electromagnetic radiation in order to weld the contact surfaces. Of course, other types of contact surface may be provided, such as sloping surfaces or non-rectilinear surfaces.

The present invention is not limited to the illustrated example but is capable of various variants and modifications which will appear to those skilled in the art. In particular, the second part may be a type of material other than a metal or a metal alloy. Thus, in a non-limiting manner, the second part may also be made of the same material as the first part, of ceramic or of a semiconductor material.

However, in that case, as explained in EP Patent 1436830, if the first and second parts are transparent to the wavelength of said laser-type electromagnetic radiation, optionally, an intermediate material intended to enhance the joint between the two materials must be used. Indeed, this intermediate material would then form a layer intended to induce sufficiently intense heating to cause the fusion of the two materials transparent to the wavelength of said electromagnetic radiation.

As explained above, the first part and/or the second part may form a variety of components of external parts. By way of additional example in FIG. 2, case 1 could be formed from a first part forming the case middle 2 and of several second parts forming the horns 3, or bracelet 10 could be formed from several first parts forming several links 11, each first part being joined to several second parts forming decorations.

Further, a first part could form a crystal 14 and be joined to a second part forming a bezel 5, a first part could form a push-button 6 and be joined to a second part forming a push-button stem, a first part could form a crown 7 and be joined to a second part forming a winding stem, a first part could form a case back 8 and be joined to a second part forming a crystal intended to show the timepiece movement, a first part could form a bracelet attachment link and be joined or secured to a second part forming a clasp or a first part could form a bracelet link 11 and be joined or secured to a second part forming a counter-link.

Finally, said optional at least a partial coating is not limited to silicon oxide, silicon nitride, silicon carbide or an allotrope of carbon. Thus, depending on the intended applications of the component, other materials may be envisaged, in order, for example, to improve the tribological, thermal or visual qualities of the component. By way of example, at least a partial anti-reflective coating may be deposited.

The invention claimed is:

1. A component of external parts for a timepiece, the component comprising:

a first silicon-based part; and a second metal-based part, wherein one surface of the first silicon-based part is welded using laser-type electromagnetic radiation onto a surface of the second metal-based part in order to secure the parts, and wherein either (1) more than one first silicon-based parts is welded onto the surface of the second metal-based part or (2) the first silicon-based part is welded onto the surfaces of more than one second metal-based parts.

2. The component according to claim 1, wherein the first silicon-based part comprises at least one of single crystal silicon, doped single crystal silicon, polycrystalline silicon, doped polycrystalline silicon, porous silicon, silicon oxide, quartz, silica, silicon nitride, and silicon carbide.

3. The component according to claim 2, wherein the first silicon-based part further comprises at least a partial coating of silicon oxide, silicon nitride, silicon carbide or an allotrope of carbon.

4. The component according to claim 1, wherein the first part(s) and/or the second part(s) forms a case, a case middle, a horn, a dial, a flange, a bezel, a push-button, a crown, a case back, a hand, a bracelet, a wristlet, a link, a clasp, a decoration, an applique, a crystal, a dial-foot, a winding stem, and/or a push-button stem.

5. The component according to claim 1, wherein the second part comprises at least one of an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, and palladium or an alloy thereof.

* * * * *